US006641283B1

(12) United States Patent
Bohler

(10) Patent No.: US 6,641,283 B1
(45) Date of Patent: Nov. 4, 2003

(54) LED PUCK LIGHT WITH DETACHABLE BASE

(75) Inventor: Christopher L. Bohler, North Royalton, OH (US)

(73) Assignee: GELcore, LLC, Valley View, OH (US)

( * ) Notice: Subject to any disclaimer, the term of this patent is extended or adjusted under 35 U.S.C. 154(b) by 0 days.

(21) Appl. No.: 10/063,334

(22) Filed: Apr. 12, 2002

(51) Int. Cl.[7] ..... F21S 4/00

(52) U.S. Cl. ..... 362/238; 362/133; 362/249; 362/238; 362/800

(58) Field of Search ..... 362/240, 231, 362/238, 800, 183, 277, 133, 140, 230, 249, 20

(56) References Cited

U.S. PATENT DOCUMENTS 5,303,124 A * 4/1994 Wrobel ..... 362/20
5,410,453 A * 4/1995 Ruskouski ..... 362/20
5,813,752 A 9/1998 Singer et al.
5,813,753 A 9/1998 Vriens et al.
5,931,570 A 8/1999 Yamuro
6,056,420 A * 5/2000 Wilson et al. ..... 362/249
6,095,661 A 8/2000 Lebens et al.
6,158,882 A * 12/2000 Bischoff, Jr. ..... 362/488
6,283,612 B1 * 9/2001 Hunter ..... 362/240
6,331,062 B1 12/2001 Sinclair
2002/0114155 A1 * 8/2002 Katogi et al. ..... 362/219

* cited by examiner

*Primary Examiner*—Sandra O'Shea
*Assistant Examiner*—Hargobind S. Sawhney
(74) *Attorney, Agent, or Firm*—Fay, Sharpe, Fagan, Minnich & McKee, LLP

(57) ABSTRACT

A lighting assembly for improving the performance of undercabinet and stream-lined lighting includes a LED module onto which is mounted a plurality of light emitting diodes (LEDs). The LEDs serve as the light source for generating a light pattern. An optical assembly focuses and disperses the LED output to a desired light contour. The lighting assembly further includes a mounting base for attaching the LED module to an associated surface, such as the underside of a cabinet. A battery source is optionally enclosed in the module for providing primary or secondary power to the lighting assembly. In a preferred embodiment, the battery source is a rechargeable battery that can be recharged by means of an AC adapter that connects to the lighting assembly.

21 Claims, 3 Drawing Sheets

LED PUCK LIGHT WITH DETACHABLE BASE

BACKGROUND OF THE INVENTION

1. Field of the Invention

This invention is directed toward an apparatus for improving the performance of undercabinet and other similar streamlined profile puck lights by providing a longer lighting life, greater efficiency and improved heat dissipation. More particularly, the invention relates to improving undercabinet lighting by replacing the standard fluorescent or halogen lamp in puck lights with a light emitting diode (LED) light source.

2. Discussion of the Art

Conventional undercabinet lighting is often in the form of small, convenient and mobile "puck" lights. These puck lights are so called because they are often round and can be mounted and moved with a minimum of effort. These lights generally utilize fluorescent or incandescent lamps as a light source. Fluorescent and incandescent lamps typically require filaments and cathode tubes for operation. As such, they are fragile and have a relatively short operating life. Furthermore, filament lamps are not the most economical to operate. In addition, by producing light by heating a filament, incandescent lamps generate a great deal of heat. This heat build up limits the effectiveness of traditional undercabinet lighting due to safety considerations and the possibility of unintentionally and adversely heating items on countertops. This heat generation also makes traditional puck lights less versatile in that some places in which such a light would be desired cannot accommodate a large buildup of heat (e.g. closets, shelves, etc.). Moreover, traditional incandescent and fluorescent lights are quite inefficient. Incandescent lights converts a large amount of energy to heat rather than light and fluorescent lamps have a relatively high start up power consumption. Accordingly, new ways to provide more efficient lighting are desired.

Light Emitting Diodes (LEDs) are solid state semiconductor devices that convert electrical energy into light. LEDs are made from a combination of semi-conductors and generate light when current flows across the junctions of these materials. The color of the light produced by the LED is determined by the combination of materials used in its manufacture. LEDs have made significant advances in providing a higher performing light source since their inception. For example, red-emitting AlGaAs (aluminum gallium arsenide) LEDs have been developed with efficacies greater than 20 lumens per electrical watt, such devices being more energy efficient and longer lasting producers of red light than red-filtered incandescent bulbs. More recently, AlGaInP (aluminum gallium indium phosphide) and InGaN (indium gallium nitride) LED's have succeeded ALGaAs as the brightest available LEDs. As a result, LEDs have become cost effective replacements for standard incandescent light sources in various applications, such as automotive brake lights, roadway work zone safety lights and red stoplights.

Nevertheless, while LEDs are more efficient than incandescent light bulbs at converting electrical power to light, there use in various applications has been limited by several factors. First, LEDs have traditionally only been able to emit low intensity light because they can only accommodate a relatively small current. For this reason, LEDs have conventionally only been used in passive illumination applications, in which light emitted from an LED enters an observer's eye directly in order to impart information about the LED (for example, as an on/off switch for an electrical circuit). Until very recently, it has been rare for LEDs to be used in active illumination systems, in which light emitted from the LED encounters an object and is reflected back to an observer, thus providing information to the observer about the object. This is because it requires a higher intensity light to provide active illumination than passive illumination due to the scattering and absorbing of the light by an illuminated object.

Second, until very recently LEDs have only been available in a limited number of wavelengths and corresponding colors. LEDs generally only emit light over a relatively narrow spectrum of wavelengths. Traditionally, LEDs were only available in red, blue and blueish-green. This limited the applications in which LEDs could be used. Recently, however, a host of new colored LEDs have become available. These include yellow, green and, most importantly, white.

As previously discussed, the current fluorescent and incandescent lamps used in undercabinet lighting have multiple components (increasing the cost to manufacture), are fragile, produce a great amount of heat and have a relatively short operating life. Furthermore, conventional undercabinet lighting is subject to failure upon power outages. Constructing undercabinet lighting with a battery powered LED as its light source or with a back-up battery power supply system would alleviate many of the foregoing problems. To date, no device exists which adequately utilizes an LED system in undercabinet lighting. Therefore, it would be advantageous to provide an LED light source for undercabinet lighting which replaces the traditional filament or fluorescent lamp with an LED light source and that overcomes the drawbacks traditionally associated with LEDs.

BRIEF SUMMARY OF THE INVENTION

In a first aspect, an illumination system is provided that includes an LED module or housing and a mounting base. A plurality of LEDs is mounted on the module to serve as a light source and generates a light pattern. At least one optical assembly is operatively associated with the housing for focusing and dispersing the light pattern. The housing can be easily mounted and removed from the base unit to provide a flexible mounting architecture.

In a second aspect, a method for forming a lighting assembly is provided. The method comprises the steps of providing a plurality of LEDs, mounting the LEDs on an LED module, providing an optical assembly, mounting the optical assembly on the LED module such that the optical assembly focuses and disperses light from the LEDs passing through the optical assembly, providing an electrical power source, and connecting the electrical power source to the LED module such that power is provided to the LEDs.

In a third aspect, an illumination system is provided that includes an LED module or housing and a mounting base. A plurality of high intensity white LEDs are mounted on the module forming at least one array and serving as a light source and generating a light pattern. At least one optical assembly is operatively associated with the housing for focusing and dispersing the light pattern. A fixing apparatus is disposed on the surface of the LED module for attaching the module to a structure's surface. A battery system provides power to the LEDs.

One advantage of the present invention is the provision of undercabinet lighting having a longer lighting life and increased reliability.

Another advantage of the present invention resides in the reduced cost of manufacturing undercabinet lighting due to the decreased number of required components.

Another advantage of the present invention is the provision of an undercabinet lighting assembly having a minimal cost of operation due to the inherently low power consumption of the device.

Another advantage of the present invention is the provision of an undercabinet light assembly having a two-part construction allowing individual lights to be easily moved and repositioned.

Another advantage of the present invention is provided by the inherently cool operating temperature of LEDs, allowing for a fracture resistant plastic light cover and improved safety.

Another advantage of the present invention is provided by a battery powered system, which also allows for emergency lighting in the case of AC power failure.

Yet another advantage of the present invention is the provision of undercabinet lighting capable of being manufactured having several different shapes.

Still another advantage of the present invention is the provision of a switch in the form of a variable resistor allowing control over the intensity of and the number of LEDs in operation.

Still another advantage of the present invention is the provision of a magnetic coupler in the base unit, allowing the base unit and the LED module to be mounted on a metal surface without adhesives or mechanical couplers.

Still another advantage of the present invention is the provision of a LED illumination system having a thin profile to allow it to be used in situations where space is limited.

Still other benefits and advantages of the invention will become apparent to those skilled in the art upon a reading and understanding of the following detailed specification.

BRIEF DESCRIPTION OF THE DRAWINGS

The present invention will be described in detail with several preferred embodiments and illustrated, merely by way of example and not with intent to limit the scope thereof, in the accompanying drawings.

DETAILED DESCRIPTION OF THE INVENTION

Figure 1:
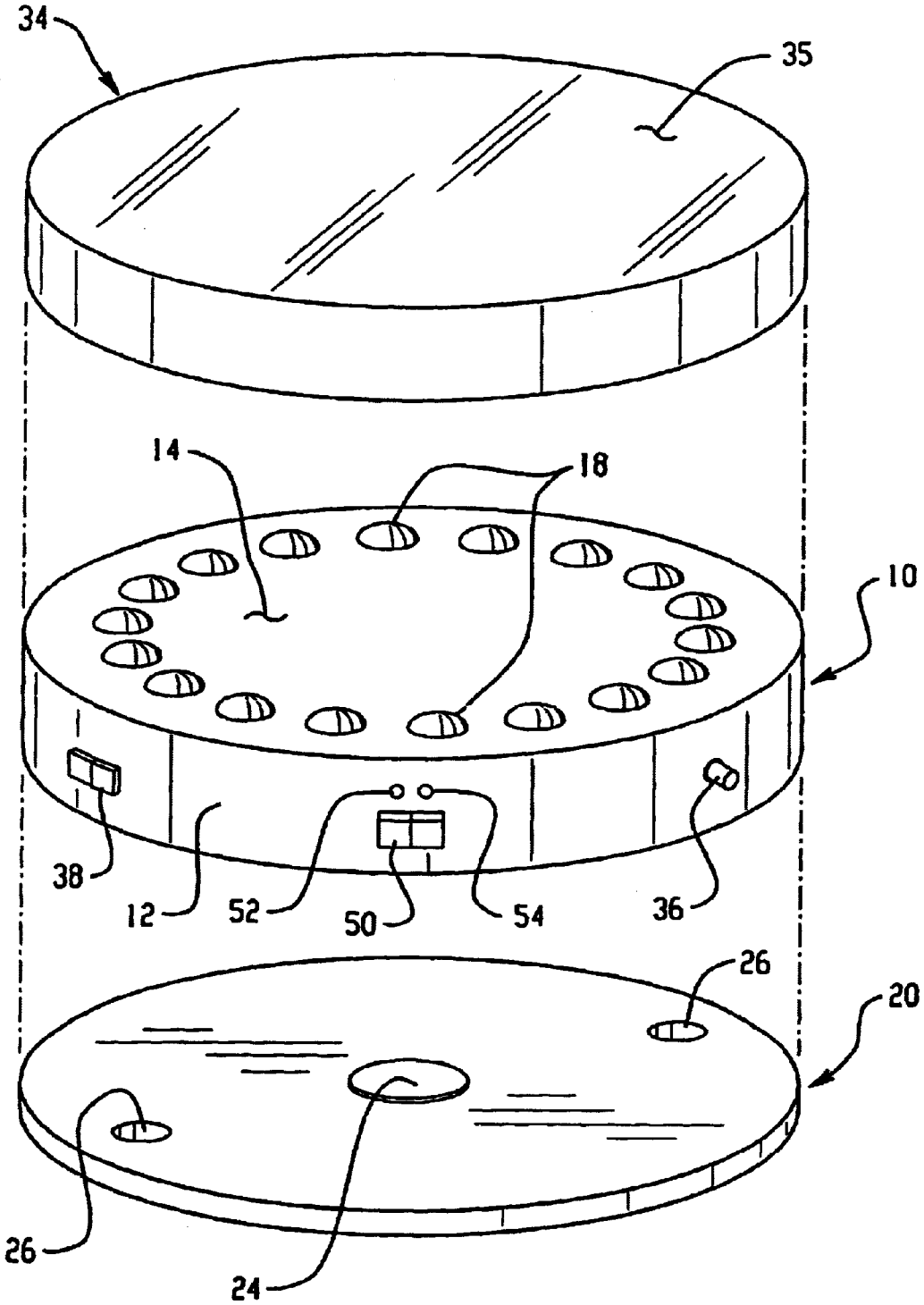
FIG. 1 is a partially exploded perspective view of a puck lighting assembly in accordance with the present invention.
Figure 2:
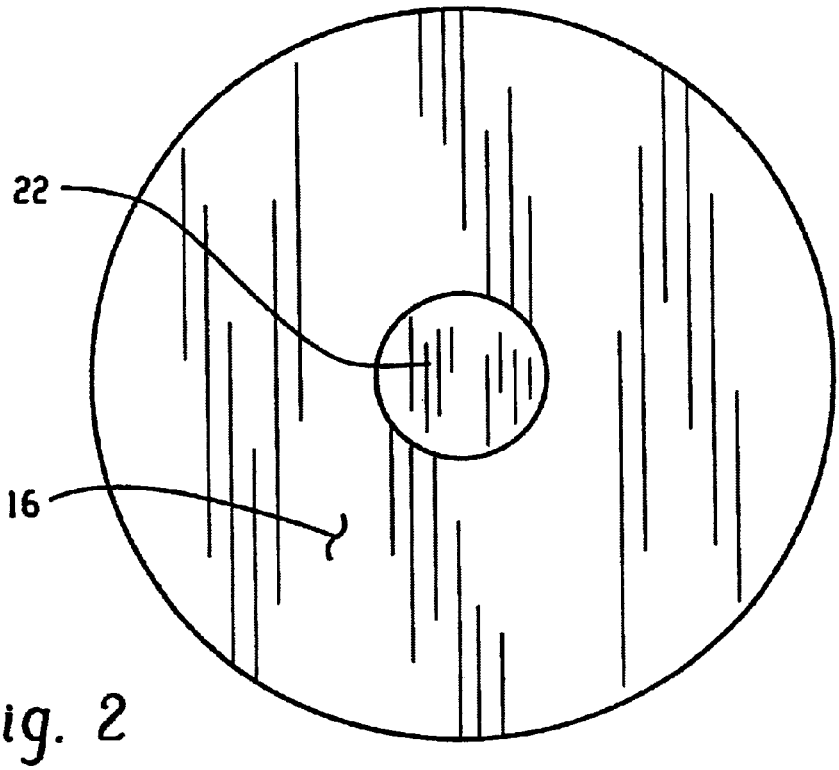
FIG. 2 is bottom view of an LED module in accordance with the present invention.

FIG. 1 shows a perspective view of an undercabinet puck lighting assembly in accordance with aspects of the present invention. With reference to FIGS. 1 and 2, the lighting assembly includes an LED module 10 enclosing the lighting components and circuitry and a mounting base 20. The LED module is defined by an annular sidewall 12 and an upper 14 and lower 16 face. Mounted on the upper face are a plurality of LEDs 18 forming at least one array. Although the upper face 14 is defined as the face on which the LEDs 18 are situated, this orientation may of course change when the light assembly is deployed. For example, the upper face 14 will actually be facing down when the light is deployed on an underside of a cabinet. The module 10 and base unit 20 are preferably circular in shape, but any other shape is contemplated by the present invention.

With reference to FIG. 2, a fixing apparatus 22 is located on the lower face 16 of the module 10 for attaching the module to a mounting structure, such as the mounting base 20 or another mounting surface. The fixing apparatus 22 may include magnets, fixing posts, Velcro, flanged heads of fasteners or any other type of connector that can be quickly and easily attached and detached from a surface. A preferred fixing apparatus is a magnet, thereby allowing the module to be quickly removed from the mounting base 20 and attached to any magnetically attractive surface, such as a refrigerator door. Two or more types of fixing apparatus may be used to permit the module to be attached to a wide variety of surfaces.

A corresponding attachment apparatus 24 is located on the mounting base 20. This attachment apparatus 24 can take many forms depending on which type of fixing apparatus 22 is located on the lower face 16 of the module 10. For example, if the fixing apparatus 22 is a magnet, the attachment apparatus 24 will be an oppositely charged magnet pole. If the fixing apparatus is a flanged fastener head, the attachment apparatus 24 will be a recess in which the flanged head will fit.

The mounting base 20 is itself attached to an associated structure (such as the underside of a cabinet) by one or more connectors 26. This connector can be any of the types mentioned above, as well as more permanent types of connectors such as nails, screws, bolts, glue etc. In a preferred embodiment, the mounting base 20 is attached to an underside of a cabinet with a permanent type of connector such as a nail or screw. In such an embodiment, the module 10 can be quickly removed from the base 20 to be used elsewhere while the mounting base 20 remains snugly attached to the cabinet. The mounting base 20 can be of similar size and shape as the module 10, in which case each module would have its own corresponding base, or it may be larger than the LED module and have space and connections for attaching several modules, as seen more clearly in FIG. 5.

Figure 3:
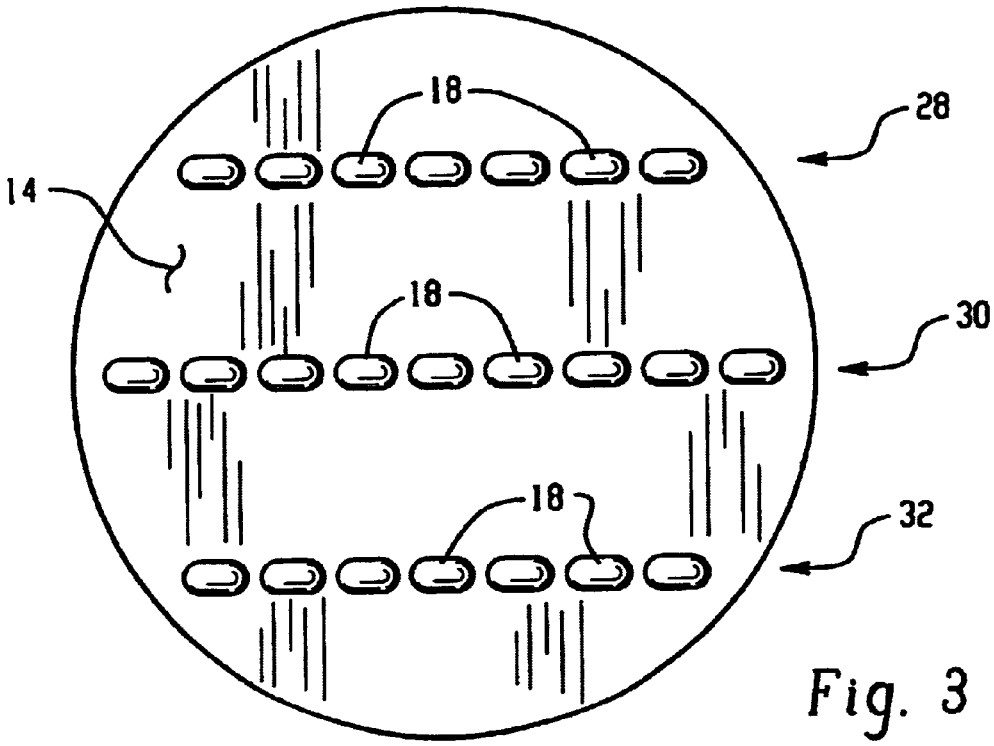
FIG. 3 is a top view of an LED module in accordance with a preferred embodiment of the present invention.

With continued reference to FIGS. 1 and 2, the plurality of LEDs 18, mounted on the upper face 14 of the module 10, operate as the light source for the lighting assembly. The LEDs 18 of the present invention replace the standard fluorescent or incandescent lamp and associated hardware, such as ballasts and sockets, which are used in conventional undercabinet lighting. The plurality of LEDs 18 from which the light source is made, form at least one array of LEDs. An array of LEDs is defined herein to mean a group of LEDs on a common circuit that are operated together. However, it will be appreciated that any number of LED arrays, grouped in any desired configuration are within the scope and intent of the present invention. For example, the LEDs may be placed in rows forming multiple linear arrays 28, 30, 32 as shown in FIG. 3. The LEDs 18 in each array can be selected to emit multiple colors of spectral output, thereby giving the desired light output, light level, and beam characteristics. Thus, for example, ALGaInP or InGaN LEDs can be used in the invention.

In a preferred embodiment, High Brightness (HB) and Ultra High Brightness (UHB) LEDs are used in the invention, which are capable of emitting light of intensities that meet or exceed that of traditional bulbs. These HB-LEDs are grown using sophisticated compound semiconductor epitaxial growth techniques, the most common of which is metalorganic chemical vapor deposition (MOCVD).

Preferably, white light LEDs are used in the invention. Suitable for use in the present invention are UV and blue LEDs that allow the possibility of generating white light from an LED by applying luminescent phosphor materials on top of the LED. In one technique, a layer of phosphor partially transforms the UV or blue light into longer wavelengths, e.g. yellow light. These LEDs efficiently extract white light by efficiently converting the UV/blue light into visible light of the desired wavelength. A detailed disclosure of a UV/Blue LED-Phosphor Device with efficient conversion of UV/Blue Light to visible light suitable for use in the present invention may be found in U.S. Pat. No. 5,813,752 (Singer) and U.S. Pat. No. 5,813,753 (Vriens), the disclosures of which are incorporated herein by reference. White light LED systems provide significant benefits over traditional fluorescent and incandescent lamps. Thus, in a particularly preferred embodiment, the LEDs 18 are high intensity white light LEDs.

As shown in FIG. 1, each LED module 10 includes an optical assembly 34 positioned over the module for focusing and dispersing the light emitted by the LEDs 18. The optical assembly 34 comprises a rigid plastic cover, although other materials such as glass are also contemplated. Such a cover may be opaque or transparent, depending on the type of emitted light desired. In addition, also included as part of the optical assembly 34 may be one or more reflectors and/or one or more lenses (not shown) to provide directional and beam characteristic control.

The optical assembly 34 is shown in FIG. 1 as being disc-shaped with a generally planar top surface 35 in order to present a streamlined profile. This thin profile design allows the lighting assembly to fit easily under cabinets without obstructing or interfering with articles positioned on a countertop. The use of LEDs, which generally take up less space than traditional bulbs, also allows for a thin design. Nevertheless, the present invention contemplates an optical assembly of any shape.

An optical assembly 34 with a planar top surface 35 can be adapted to diffuse or modify light from the LEDs as it passes through the optical assembly. In this respect the optical assembly 34 can be opaque or transparent, depending on the type of emitted light desired. The top surface 35 of the optical assembly may be smooth such that light from the LEDs passes through it without substantial refraction. Alternately, the top surface 35 can be equipped with light modifying structures (not shown), such as plate diffusers, fresnel lenses or prismatic output couplers.

The optical assembly 34 can be adapted to move or rotate so that the focus and the dispersion of the light pattern from the LEDs 18 can be adjusted as desired. The optical assembly 34 may be made from a variety of materials, including glass and various thermoplastics. Due to safety concerns, the optical assembly 34 is preferably made from a rigid, shatter-resistant thermoplastic. As desired, the optical assembly can be made either translucent or transparent, and allowing light from the LEDs 18 to be focused to form either a spot-like optical output or a diffuse, uniform output.

Alternatively, the focus and dispersion may be adjusted by fixing the optical assembly 34 and allowing the top surface 14 of the module 10 to move or rotate. This may be accomplished using a manually operated focusing knob 36 or any other known means for adjusting an optical lens or LED array. The focusing knob 36 may be situated in any convenient location, such as on the annular side wall 12.

To regulate the intensity of the light LED beam, a switch 38, coupled to a variable resistor (not shown) located inside the module, may be provided on the exterior of the module 10 for allowing variable optical output. The switch 36 can be designed as a rheostat so that it is possible to change the resistance value without interrupting the circuit to which it is connected. Pulse width modulation using an IC chip for dimming is contemplated as well. If multiple arrays 28, 30, 32 of LEDs are present on a single LED module 10, multiple switches 38 may be present to independently control each array. In this way, a user may adjust the optical output to any desired level. Other means of controlling the light output, such as a single on/off switch are also contemplated. In such an arrangement, the intensity of the beam cannot be varied.

Alternatively, or in addition to the rheostat design, the switch 38 can be designed having step level variable control which allows a user to choose from distinct levels of illumination. For example, the switch may be designed having two modes of illumination, the first mode providing full illumination while the second mode providing partial illumination. When operating at partial illumination, the undercabinet light source may be used as a night-light. As mentioned, such a design may be used in conjunction with a rheostat variable resistor or other digital dimming means.

In addition to allowing the user to adjust the optical output of the light source, the switch 38 may be adapted to enable the user to selectively turn on and off any number of LEDs 18 in each array. In order to achieve such a feature, the variable resistor is designed to selectively short-circuit predetermined sections of the resistor or switch certain LEDs out of the circuit. Therefore, the user can operate the switch to selectively turn on and off any number of LEDs as desired. Of course, multiple switches may be used to perform the noted functions described herein as being performed by the single switch 38

Figure 4:
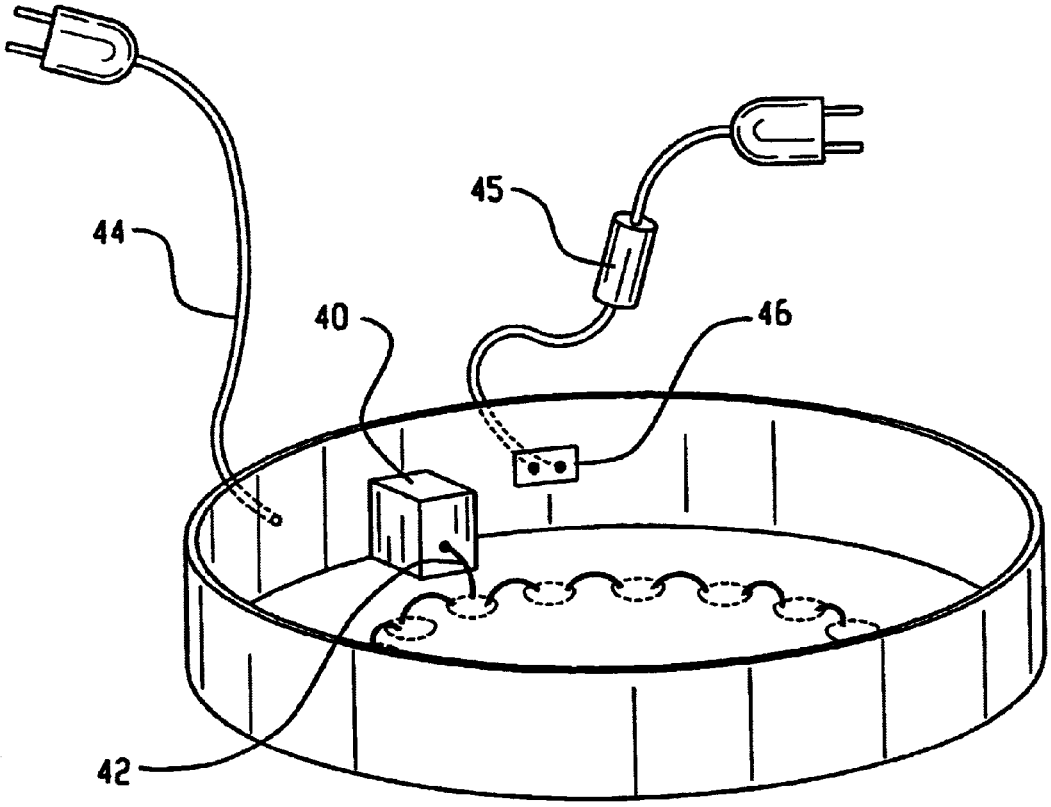
FIG. 4 is a perspective view of the interior of an LED module in accordance with one embodiment of the present invention.

With reference to FIG. 4, the undercabinet lighting assembly is preferably powered by a DC voltage source such as a battery system 40. The battery system is preferably housed in the LED module 10, such as on the inside of the annular wall 12, enabling the module to be easily removed from the mounting base 20 and put anywhere that a light is needed without the need for external wires or an AC power connection. The battery system 40 may be housed in a battery compartment (not shown). The batteries can be of any desired type and size, including but not limited to alkaline, nickel cadmium, standard, heavy duty, lithium, nickel metal hydride and others. Also enclosed in the module are various wires 42 for connecting the battery to the LEDs. In a preferred embodiment, the batteries are rechargeable.

Alternately, or in addition to being powered by a DC voltage source, the lighting assembly may be connected to a power source, such as an AC power source, via a cord 44 adapted to plug into any conventional electrical outlet (not shown). The lighting assembly may thus be powered either directly from the AC wall plug, or alternately, if driven by rechargeable batteries, periodically recharged via an AC plug-in adapter/recharger 45. The AC adapter/recharger 45 may be plugged directly into an outlet 46 on the LED module 10 or it may be integrated into the mounting base 20. Alternately, the AC adapter/recharger and the AC power cord 44 may be a single structure capable of both directly powering the lighting assembly and recharging the batteries. If the AC adapter is integrated into the mounting base 20, the mounting base must have an AC power cord and the AC power is supplied to the battery system 40 via connecting circuitry (not shown) on the bottom of the module and the top surface of the base unit.

Figure 5:
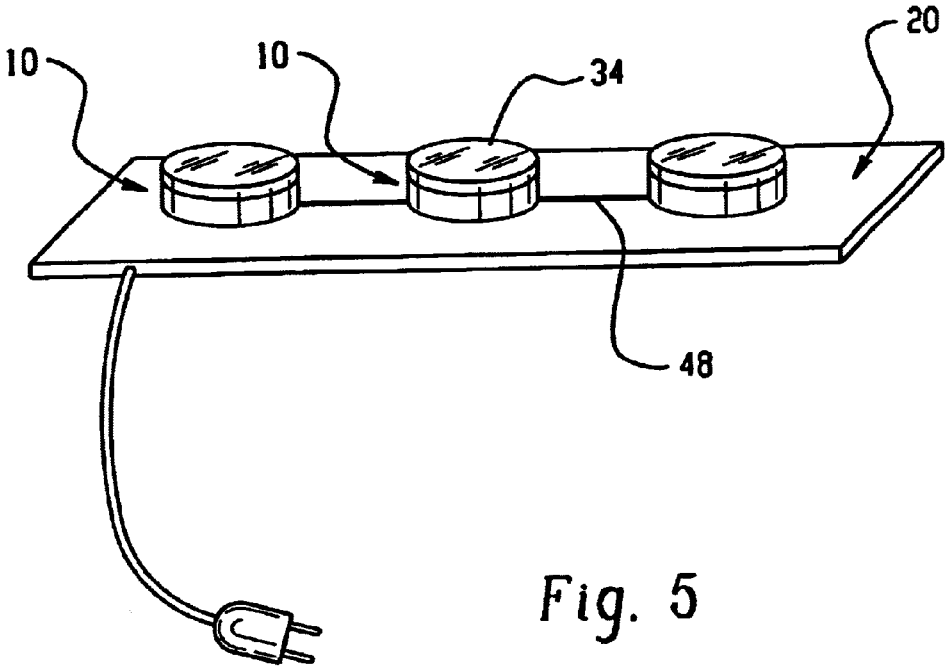
FIG. 5 is a perspective view of several LED modules on a single mounting base in accordance with a preferred embodiment of the present invention.

As shown in FIG. 5, a linear configuration of LED modules 10 powered by a single AC plug may be realized by mounting multiple LED modules 10 on a large unitary base unit 20. The base unit 20 is equipped with an electrical circuit 48 that supplies power to each attached LED module 10.

A power source selector 50 may be provided on the annular side wall 12 of the module to determine what source of power the lamp will use during operation. An AC power source indicator 52 and a battery source indicator 54 may be disposed on the annular side wall 12 of the module 10 for indicating which source of power is being utilized. One skilled in the art will appreciate that the battery life can be controlled by controlling the intensity of the LED beam with the switch 38.

In an exemplary embodiment, when the lighting assembly is configured to be using AC power, the battery system 40 is adapted to automatically turn on the light source upon failing or faulting of the primary power source. A sensor (not shown) detects when AC power is no longer available and sends a signal to the battery system 40 to supply power to the light source. This feature is particularly useful during power outages.

The module 10 is preferably made from a tough, lightweight, and inexpensive thermoplastic, although other materials may be used. The use of plastic in the manufacture of the lighting assembly without safety concerns is due to the cool operational temperature of LEDs. The use of such materials in the construction of the lighting assembly makes these lights quite versatile, allowing them to be used in various environments where the threat of breakage or fire would discourage the use of traditional lights. Thus, in addition to undercabinet lighting, these lights can be stuck on walls, outdoor pathways, refrigerator doors, and in basements and garages. In addition, the undercabinet lighting assembly may be made of a flexible material such as rubber or an elastomeric material. As such, the module 10 can be bent into any shape or configuration as desired. Such a flexible module 10 allows the user to utilize the light source in several different environments. Such a feature may be achieved because of the unique characteristics of LEDs. LED light sources have significantly fewer components than standard fluorescent or incandescent lamps. In addition, unlike standard fluorescent and incandescent lamps, LEDs do not have fragile parts such as filaments, electrodes, etc. Therefore, LED light sources do not require a large housing made from a protective rigid material and can thus be made of a flexible material.

The invention has been described with reference to the preferred embodiment. Obviously, modifications and alterations will occur to others upon a reading and understanding of this specification. The invention is intended to include all such modifications and alterations in so far as they come within the scope of the appended claims and the equivalents thereof.

What is claimed is:

1. A lighting assembly comprising:

a mounting base;

an LED module detachably mounted on the mounting base;

a first plurality of LEDs mounted on the module forming at least one array of LEDs, the LEDs serving as a light source;

an optical assembly operatively associated with the LED module for focusing and dispersing light from the LEDs passing through said optical assembly; and, a DC power source housed in the LED module.

2. The lighting assembly according to claim 1, wherein said LED module is made of a thermoplastic.

3. The lighting assembly according to claim 1, wherein said DC power source is a rechargeable battery.

4. The lighting assembly according to claim 1, further comprising an AC power adapter/recharger for providing AC power to said plurality of LEDs and for recharging said DC power source.

5. The lighting assembly according to claim 4, wherein the DC power source automatically provides power to the lighting assembly upon AC power failure.

6. The lighting assembly according to claim 1, further comprising a switch for controlling a level of light output by the LEDs.

7. The lighting assembly according to claim 6, wherein the switch provides a step level variable control having at least two distinct levels of illumination.

8. The lighting assembly according to claim 6, wherein said switch is connected to a variable resistor allowing continuous variable control of the level of optical output.

9. The lighting assembly according to claim 1, wherein said LEDs are arranged in at least one array, each array being on a separate circuit allowing separate control of a level of light output of each array.

10. The lighting assembly according to claim 9, further including a switch for selectively turning on and off any select number of arrays of LEDs.

11. The lighting assembly according to claim 9, wherein each array has a plurality of LEDs having different colors of spectral output for achieving desired light output, light level, and beam characteristics.

12. The lighting assembly according to claim 1, wherein the LEDs are high intensity white light LEDs.

13. The lighting assembly according to claim 12, wherein the LEDs are phosphor-coated UV/Blue LEDs.

14. The lighting assembly according to claim 1, wherein the optical assembly comprises a thermoplastic lens.

15. The lighting assembly according to claim 1, wherein the optical assembly is selectively adjustable for focusing and dispersing the LED beam as desired.

16. The lighting assembly according to claim 1, wherein said LED module comprises a fixing apparatus for attaching said LED module to a mounting surface.

17. The lighting assembly according to claim 16, wherein said mounting base comprises a attachment apparatus for cooperatively connecting to said fixing apparatus.

18. The lighting assembly according to claim 1, further comprising a connector for attaching said mounting base to an associated structure.

19. The lighting assembly according to claim 1, wherein a plurality of LED modules are attached to a single mounting base.

20. A method for forming a lighting assembly comprising the steps of:

providing a plurality of LEDs;

providing an LED module having an upper face and an opposed lower face;

mountings said LEDs on said upper face of said LED module;

attaching said lower face of said LED module to a mounting base;

providing an optical assembly;

mounting said optical assembly on said LED module such that said optical assembly focuses and disperses light from the LEDs passing through said optical assembly;

providing an electrical power source housed in the LED module; and connecting said electrical power source to said LED module such that power is provided to said LEDs.

21. A lighting assembly comprising:

a mounting base;

an LED module having an upper face and an opposed lower face;

a first plurality of high intensity white LEDs mounted on the upper face of the module forming at least one array of LEDs, the LEDs generating a light beam and serving as a light source;

an optical assembly operatively associated with the LED module for focusing and dispersing the light beam passing through said optical assembly;

a connector for attaching said mounting base to an associated structure;

a fixing apparatus disposed on the lower face of the module for attaching the module to the mounting base; and a battery system housed in the LED module for providing power to the LEDs.

* * * * *